United States Patent [19]

Consiglio

[11] 4,199,630

[45] Apr. 22, 1980

[54] CONTINUOUS PAPER STRIP OR THE LIKE TO FORM INVOICES AND THE LIKE TRANSFORMABLE INTO CLOSED COVERS

[75] Inventor: Luciano Consiglio, Grottaferrata, Italy

[73] Assignee: S.I.P. Societa' Italiana per l'Esercizio Telefonico P.A., Italy

[21] Appl. No.: 822,924

[22] Filed: Aug. 8, 1977

[30] Foreign Application Priority Data

Mar. 24, 1977 [IT] Italy ..... 48616 A/77
May 26, 1977 [IT] Italy ..... 49571 A/77

[51] Int. Cl.[2] ..... B65D 27/10; B65D 27/16

[52] U.S. Cl. ..... 428/43; 156/217; 156/227; 156/252; 229/69; 229/92.1; 428/44; 428/78; 428/136; 428/195

[58] Field of Search ..... 428/43, 47, 76–78, 428/195, 337, 44, 54, 133, 136; 156/252, 217, 227, 291; 93/63 R, 63 M, 61 R, 62; 229/69, 75, 80, 81, 92, 92.1, 73; 282/11.5 R, 11.5 A, 25

[56] References Cited

U.S. PATENT DOCUMENTS

| | | | |
|---|---|---|---|
| 786,436 | 4/1905 | Goodman | 229/92.1 |
| 2,051,711 | 8/1936 | Heywood | 229/80 |
| 2,773,638 | 12/1956 | Krohn | 229/92 |
| 3,523,638 | 8/1970 | Moonan | 229/92.1 |
| 3,837,565 | 9/1974 | Johnsen | 229/81 X |
| 4,023,727 | 5/1977 | Tess | 229/69 |

FOREIGN PATENT DOCUMENTS

| | | | |
|---|---|---|---|
| 776000 | 1/1968 | Canada | 229/92.1 |
| 5634 | 9/1892 | Switzerland | 229/92.1 |

*Primary Examiner*—Michael G. Wityshyn
*Attorney, Agent, or Firm*—McGlew and Tuttle

[57] ABSTRACT

A continuous paper strip is provided with a first plurality of transverse tear lines spaced apart from each other to divide the strip into a plurality of strip elements having a desired height. Each strip element is subdivided into a first and second part of different heights by a transverse folding line. The first part has a height "h+d", where "h" is the height of the invoice, bill or the like, and "d" is the width of the bands on which an adhesive is applied. The second part has a height "h+2d". Longitudinal slots are purchased at each side of the first part of each strip element each having a width equal to "d". On the main face of the strip and near the transverse folding line separating each strip element, an adhesive is applied on a band of a width substantially equal to "d", while at the opposite face of the strip and on the second part of each strip element an adhesive band is applied near the tear line.

6 Claims, 6 Drawing Figures

CONTINUOUS PAPER STRIP OR THE LIKE TO FORM INVOICES AND THE LIKE TRANSFORMABLE INTO CLOSED COVERS

BACKGROUND AND FIELD OF THE INVENTION

The present invention relates to a continuous strip made of a sheet material, such as paper, thin board and the like. The strip is designed to be used in data-processing apparatus, computers, data memories for the drawing up of invoices, bills, certificates, reports and the like which have to be sent separately to the parties concerned.

Near each longitudinal edge of the continuous strip a series of conventional holes or perforations is arranged which are engaged by the dragging and guiding means of a machine which is used in the drawing up apparatus so that the strip can advance below the data writing means in a predetermined relationship and at predetermined time intervals.

According to the present invention the strip is shaped and constructed in a particular manner so that it can be successively separated into strip elements or lengths to be transformed into closed covers. For such a purpose the strip is provided with a plurality of transverse tear lines spaced apart from each other by a predetermined distance and adapted to allow the strip to be separated into strip elements to form cover sheets of a desired length. Each of these strip elements consists of two parts having different heights. The strip also comprising two series of longitudinal slots, substantially spaced apart by the same distance from the adjacent longitudinal edges of the strip and positioned at the sides of that part of each strip element which has the smaller height. These slots have a length equal to the height of the shorter part of the strip element.

An adhesive agent is applied on the front surface of the strip of the self-adhesive and non-permanent type. This adhesive is applied in transverse bands of a width slightly less than that of the aforementioned slots. The adhesive bands being adjacent the respective transverse folding lines of each strip element and on the part thereof which has the smaller height. On the opposite strip surface transverse adhesive bands are provided, each adjacent one of the transverse tear lines and on that part of each strip element which has the higher height, while other adhesive bands of the same type and width, and of a length equal to the height of the part of the strip element having the smaller height are respectively applied in longitudinal alignment with the two series of longitudinal slots.

For particular intended purposes, as for instane, in the instance where the strip elements are used to form invoices, bills or the like, a second plurality of transverse tear lines are provided in the continuous strip offering a higher tearing resistance than the first plurality of tear lines and which are provided in close proximity to the transverse adhesive bands applied on the front surface of that part of each strip element having the smaller height and near that edge of the band which is opposite the edge along which is performed the transverse bending of the strip element. A longitudinal tear line could also be provided to separate the part having the smaller height of each strip element into two halves. In the instances where the invoice must comprise a form which is positioned on its side for payment of an amount by a post Office this form is particularly useful. The strip may also previously receive the printing of all the framings, outlines or the like adapted to receive particular references, informations and data, relative to the users and which are printed on the front surface of the first part of each strip element designed to form the invoice or the like, while various information and/or instructions can be printed on the opposite surface of the strip elements. Accordingly, on the front surface of the second, higher part of each strip element, which is subdivided into two equal portions by a longitudinal folding line, a space may be provided on onehalf for the data and address of the sender and for that of the adressee, which are printed thereon. The other half of the second part can be used for other communications from the sender to all the users of the service utilizing this invention.

The continuous strip of the invention is intended for solving important problems, i.e.: to reduce work needed and materials used for preparing and sending invoices, forms, bills, bank reports, certificates and the like and, at the same time, to provide covers adapted to automation systems of the postal Services.

DESCRIPTION OF THE PRIOR ART

Now referring, in particular, to a conventional operation which is used for preparing invoices or bills that are drawn up by means of computers, data storage apparatus and the like; normally such invoices or bills are prepared using strips formed of series of invoice forms which have not yet been filled out. One of these strips is inserted into the respective apparatus which automatically enters on each strip element all the relative data concerning, for instance, the consumption, the unit cost, the taxes amount and the amount to be paid by a given user. At the same time the address of the user is printed on the form. Then the strip is separated into respective strip elements, each constituting a completed invoice or form, which is then to be inserted into an envelope. The envelope is generally of the type having a transparent window which is so positioned that the address written on the invoice or bill can be viewed through this transparent window. At present this operation is performed partly automatically and partly manually. However, even if this invoice has been carefully drawn up, in order to make its insertion into the envelope easier the envelope, must be of a size slightly greater than that of the folded invoice. What often occurs then, is that the address will not be exactly positioned underneath the transparent window. The address therefore remains partly invisible and/or it is not parallel to the lower edge of the envelope, which is necessary for its easy reading.

At the present time postal services tend to be automated as far as possible so that now it becomes customary to use electronical optical readers for the addresses, the readers being able to operate only in the event that an address is written in a predetermined position and can be well viewed through the window. Further the address must be written parallel to the lower edge of the envelope or cover. Therefore all those envelopes or covers are discarded in which all the requirements have not been fulfilled. Such discarded mail will be collected manually and directly examined by operators according to a working system which is obviously slower and more expensive so that, where this automated working system is applied, the mail which has not been correctly prepared tends to be subjected to a penalty fine which compensates the postal Service for the greater burden caused by this manual working. The time needed to deliver this uncorrectly prepared mail will also be very long; therefore, in particular the services, utilities, Organisations and the like, which are designed to perform mass services are urged to employ any means in order to reduce the cost of mailing invoices, bills and the like, including eliminating the use of envelopes, as well as all the operations inherent to the putting of each of the invoices into their respective envelopes, so as to also obtain a cover which meets the requirements of the new automation systems of the postal Services.

At present, for large Organizations, in particular, the utilities or Bodies performing mass Services, there is a problem in delivering commercial mail, such as invoices, bills, and the like, by employing a minimum of labor and in a time as short as possible, with a minimum cost of material and, at last, so as to fulfil the Rules of the Universal Post Union (U.P.U.), to which all the Countries of the world now are in the course of accepting. These rules aim to standardize all the characteristics of correspondence, according to criteria adapted by the Unior to allow for automation by means of an automatic processing of correspondence, including optical reading of the addresses though known information data, (Post Delivery Code=C.A.P., etc.) which are duly coded. In addition, it is of the highest interest for these Bodies or Utilities to have the possibility of effecting an automatic checking or verification of correspondence received by them, in particular, when invoices for paying bills or the like are concerned, which can be associated with forms for a payment on the Post Current Account. They can be automatically read by an optical reader by means of the coded informations typewritten on the A/C or "Account-Current" form which serves as a checking means of the payments for the issuing Body.

In order to satisfy the characteristics required by the U.P.U. Rules, without taking into consideration the size and weight of the covers, it is necessary, in particular:

(a) to eliminate all the opening lines obtained by a series of aligned perforations (tearing lines) so as to prevent the accidental opening of a cover during its transport;

(b) to carefully seal the closure limbs up to their outer edges so as to prevent one cover from getting stuck into the limbs of another cover;

(c) the paper in the reading area must be preferably white or, in any case, suited to permit the address to be seen well;

(d) to avoid the use of envelopes having windows, the transparency of which is due to a chemical process which do not have constant reflectivity over the whole reading area;

(e) the address must be written in correct horizontal alignment, i.e. parallel to the lower edge of the cover (a maximum inclination of $\pm 5°$ being admitted).

To such requirements another requirement can be added. If the Body, which carries on the Service and which uses the forms for these invoices, provides an optical checking or verification operation, it is necessary that the form sheet remains clean and free of superfluous marks in those zones on which the coded information has been typewritten in order to allow said checking. It is also important that the information be in black ink which remains unalterable as time passes. Several attempts have been made to provide a single cover (consisting of at least two paper sheets) adapted to substitute for the covers which presently consist of an envelope, an eventual advertising form and an invoice that is provided not only for the aforementioned reasons, but also for making the covers less expensive, for reducing labor and for realizing a speedy operation.

The proposed solutions however do not fulfill the afore mentioned requirements. In fact, according to a first solution, the cover is constituted of three superposed paper sheets, the outer first and third sheets being connected to one another along three of their edges by a bonding means, while along the fourth edge they are connected also to the second or central sheet. The second or central paper sheet is designed to form the invoice or bill. Along the forth peripheral edge of the cover there is provided a connection band and along the inner side of this band is provided a tearing line to allow for the separation of the side paper band from the cover so to allow for the removal of the central sheet. To the inner surface of the first sheet is applied a coating of a transfer agent (as for instance, a carbon coating or other transfer means obtained by a chemical treatment) adapted for reproducing information which is typewritten on the outer surface of the first sheet that is acting as an envelope, onto the front surface of the second or central sheet of the cover. Of course, it is necessary to perform a due obliteration of the areas of the front surface of the first sheet, on which the information, reproduced mechanically thereon, must not appear.

This solution has the following disadvantages:

(1) presence of outer tear lines;

(2) presence of obliteration areas below the address space;

(3) size of the inner sheet has an area too small and therefore incompatible with the requirements of the size of a form to be used for an A/C payment and for an invoice and in order to fulfil the U.P.U. Rules;

(4) possibility of creating rulings, spots and the like due to the inner transfer coating on the areas of the invoice designed to receive the information which serves for the issuing Body, to perform checking or verification operations;

(5) exorbitant price of this cover.

A second solution is similar to the preceding one. It provides a cover constituted by only two superposed sheets. These sheets are connected to one another along a peripheral band by an adhesive agent. Along the inner edge of said peripheral band a perforated tearing line was arranged permitting the tearing away of the peripheral band of said cover so as to allow for the separation of the two remaining portions of the sheets. The first of these is designed and constructed as the first sheet of the known cover of the aforementioned first solution, and the second sheet constitutes the invoice. This solution which is slightly less expensive than the preceding one, has all the disadvantages of the first solution.

Still another solution is known which is substantially identical to the second solution, but which provides the use of three superposed sheets instead of only two.

A last solution is substantially identical to the first solution with the exception that the first sheet is provided with an open window so positioned to be placed upon the space on which the information is to be written, necessary to the issuing Body to perform the automatic checking operation so that said information is obtained by typewriting the data directly, and not by a transfer process, through the open window, thus avoiding any risk of rulings or spots on this area, as aformentioned. Against this sole advantage there are all the aforementioned disadvantages of the other cited solutions. In addition, there is also another important disadvantage. This is the cut of the open window can cause a mutual entrapping of the covers during the sorting of the correspondence, and, for this reason, these covers do not fulfil the U.P.U. Rules.

Other solutions are substantially variants of the aforementioned solutions.

SUMMARY OF THE INVENTION

The strip according to this invention solves the aforementioned problems, since it permits the application of data onto the invoices and the application of a user's address on each of the plurality of strip elements of the strip which can then be readily mechanically separated from each other along tear lines. Each strip element can then be mechanically folded along a transverse folding line so that the back portions of the two parts forming the strip element overlap one another and in such a way that, after this step is performed, a rectangular cover element is obtained in which the first shorter part of this element overlaps with its back surface the second longer part of the strip element. In this position of the two parts of the strip element, all the adhesive bands are brought into view on one surface, i.e. the transverse adhesive band, applied on the front surface of the strip, and the adhesive transverse and longitudinal bands applied on the opposite surface of the strip so that the cover in this step, as viewed from its inner area, presents an adhesive band along the whole periphery thereof. Therefore, when the cover is folded along its centre line which was the longitudinal centre line of the continuous strip, a closed cover is obtained, taking into consideration that for such a purpose an adhesive agent must be employed which can only adhere to an adhesive layer of the same type, while, on the contrary, it cannot adhere to the paper surface or the like of the strip.

The present invention further provides means enabling an easier and quicker mechanical folding of the strip elements, increasing the speed of the folding and of the bonding step of the adhesive bands on which the adhesive has been applied. This also provides air, which could be entrapped in the folded parts of the cover, to freely escape.

For such a purpose the present invention provides that the adhesive is not applied on those short portions of the adhesive longitudinal bands, there they encounter the transverse bands. Nor is adhesive applied near the ends of the longitudinal slots, which are used for the purpose of defining gripping paper limbs near the corners of the cover to make the opening of this cover easier. This also creates air passages. No area along the longitudinal line of the strip is present, which will be the centre folding line of each strip element. This is important so that detectors which serve to a superposition of more than two paper layers remain accurate in their readings. An increased thickness reading could be due to the overlapping of more than one strip element which, for any reason, could remain attached to each other. These detectors have the role of stopping the paper bending machine operation in abnormal operative conditions.

These and other characteristics and advantages of the present invention will be better understood from the following description taken in consideration together with the accompanying drawings, showing an embodiment of a cover designed to be used as a payment invoice, but which has been given merely by way of example and without limiting this invention. Dr

DESCRIPTION OF THE PREFERRED EMBODIMENTS

Figure 1A:
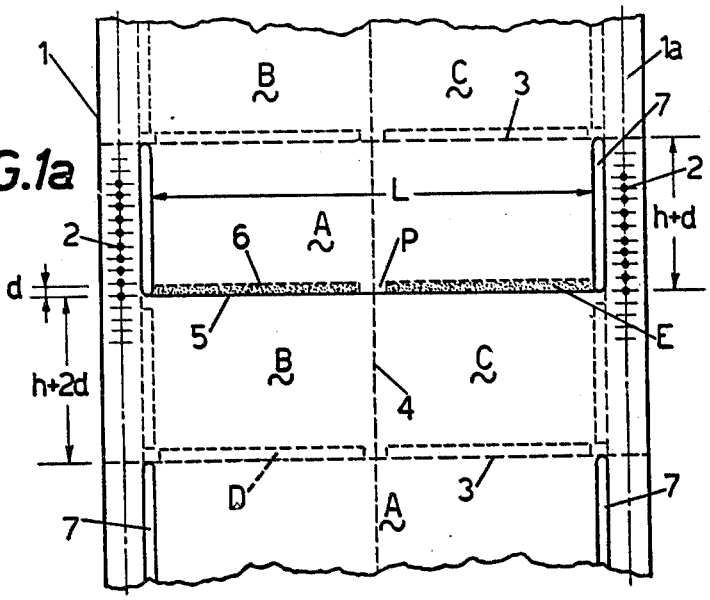
FIG. 1*a* is a top plan view of a portion of a continuous web or paper strip made in accordance with the invention.
Figure 1B:
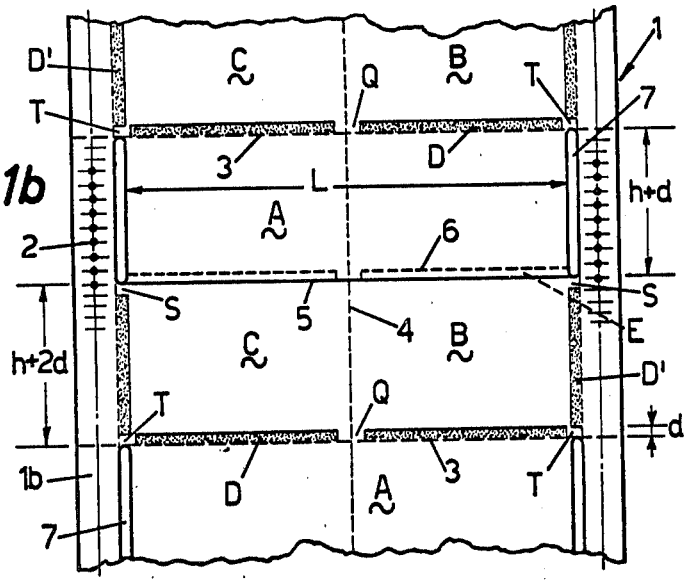
FIG. 1*b* is a bottom plan view of the embodiment shown in FIG. 1*a;*

Now referring to the drawings FIGS. 1*a* and 1*b*, a continuous strip generally designated 1 comprises a front face 1*a* seen in FIG. 1*a*, and a back face 1*b* seen in FIG. 1*b*. On the main face 1*a* the data entry or writing is performed. In the shown embodiment strip 1 is designed to form a plurality of covers, each including a first part which serves as an invoice for the payment of a public service, as, for instance, telephone, water, gas, etc. Near each longitudinal edge of the strip 1 a series of aligned holes 2 is provided designed to engage means known per se for guiding and dragging the strip 1 into the apparatus provided to supply the data to be reproduced on said strip 1.

For this specific intended purpose, the strip 1 is provided with a first plurality of transverse tear lines 3, which are spaced away from each other at a predetermined distance "2h+3d", where "h" is the height of the first part A of each strip element designed to form that part of a cover which will serve as invoice or the like, and "d" is the width of the closure edges of the cover to be obtained from each strip element. A longitudinal or center line 4 is provided along which will be performed the second bending step of each strip element, while transverse lines 5 are provided along which in each strip element the first bending is performed, each line 5 subdividing a strip element, which is formed between two adjacent lines 3, into two parts, i.e. a first part which has a height equal to "h+d", and a second part which has a height equal to "h+2d". In the event that provision is made that the portion A of the first part of the strip element, which has a height "h" and a length "L" and which is designed to form the invoice, must be separated from the remaining portion of the cover, which includes also the spaces B and C placed underneath the line 5 and which will constitute the outer envelope of the cover with their surface 1*a*, on the strip 1 a second plurality of transverse tear lines 6 are arranged, intermediate to the plurality of tear lines 3 but which are obtained in such a way to be less easily torn than the lines 3. These lines 6 are arranged on the first or short part of each strip element so as to define the lower edge of the invoice A, and to be spaced apart from the adjacent bending line 5 by a distance "d". A transverse band E is defined between lines 5 and 6 which has a height equal to "d". This band E is a part of the first short part A of the strip element. It is to be pointed out that the tearing line 6 always remains in the inside of the cover so as to fulfil the U.P.U. requirements. The band E is coated with an adhesive only on a portion of its width so as to leave small longitudinal edge portions free for a few millimeters. This is done in order to prevent a blurring of adhesive from reaching the portions A, B and C of the cover, thus causing undesired bonding thereof during the working and the handling of the strip elements. In addition the adhesive is applied only for a distance of about 1.5 cm from the folding line 4 so as not to create a zone of an increased thickness near the line 4 after the folding, and so that a control detector associated with a bending machine will not misinterpret the single cover as being more than two overlapping paper layers. As a result thereof a central area P will be provided on the band E without adhesive.

At both sides of the portion A of the first part of the strip element, designed to form an invoice and at the ends of the adhesive band E, longitudinal slots 7 are cut. These are substantially equally spaced apart from the longitudinal edges of the strip 1. The inner edges of the slots 7 define the length L of the invoice A. The slots 7 will have a width substantially equal to "d". On the face 1*b* of the strip 1 is applied the same adhesive, used to form the adhesive band applied on E, the adhesive being applied on a transverse band D of a height "d" adjacent each line 3, but provided on the long or second part of each strip element. Also in this case the adhesive will be applied only in the innermost portion of the band D so as to leave short longitudinal outer edge portions of the band D without adhesive for the same purpose as specified with reference to the adhesive applied on the band E. Identically on the band D at both sides of the line 4 will be provided an area Q without adhesive for the same purpose as the area P on the band E. In addition the adhesive is also missing at the end portions or areas T of the band D in order to provide air passages to let the air entrapped between the inner walls of the cover during the folding and bonding steps flow freely out from between the cover halves.

According to the present invention, provision has also been made to apply the adhesive on the longitudinal bands D', positioned in alternating fashion with the slots 7. In this case as well as the adhesive is applied only up to a distance greater than "d" from the ends of the slots 7, preferably at a distance of about 1.5 cm, so as to leave an area S free of adhesive, said adhesive being also in this case applied in such a manner that it cannot reach the edges of the bands D'. The areas S without adhesive have two functions. One is to form in the cover, in its closed condition, two gripping limbs for the opening of the cover since an adhesive of self-bonding, but non-permanent type is used, and the other function is to permit the preparation of the strip 1 which has previously been bent in a bellow or accordeon disposition according to a common preparation method of the paper strip for the aforementioned purposes. Each strip 1 is prepared in such a bellows form, each folded portion of the bellows being bounded by a line 3 so that each folded portion preferably, forms one strip element.

According to this disposition the transverse adhesive bands D and E can never overlap each other as well as the longitudinal bands D', owing to the presence of the areas S without adhesive. It is to be pointed out that in the event the part A, for particular intended purposes, must be separated into two halves along the centre line 4, the portion of the line 4 which passes through the part A and the band E will be substituted with a tear line which extends beyond the line 3 by about 2 mm so as to have a height of h+d+2 mm. This is done, if the invoice embodies also a form for the payment thereof in A/C, and this tear line also promotes a correct folding of the cover along the centre line 4.

Figure 2A:
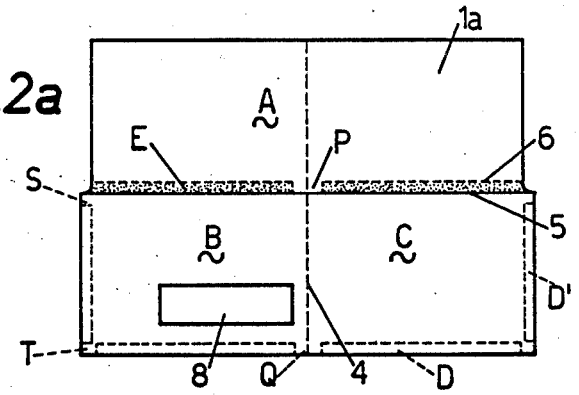
FIG. 2*a* is a top plan view of a single strip element comprising a top or first invoice portion and a bottom or second cover portion as separated from the web or continuous strip of FIGS. 1*a* and 1*b;*
Figure 2B:
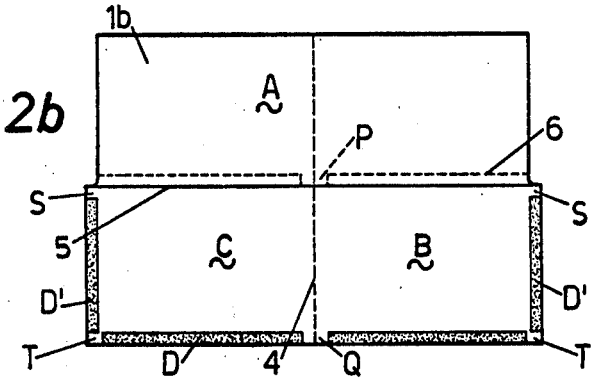
FIG. 2*b* is a bottom plan view of the strip element shown in FIG. 2*a;*

On the face 1*a* of the strip 1 will be printed or reproduced in any other suitable manner, in particular on the part A, all the informations or indications relative to an invoice in general, as well as framings defining the spaces to receive the various data and the indications of the destinations thereof. Then the computer or the like reproduces in sequence the data relative to each user, as for instance, the data of the preceding reading of the counter, those of the last reading, the consumption amount, the amount of the taxes and, however, all the data which normally are reproduced on an invoice, which is "per se" of a well known type, while on the opposite face of each strip element will be printed the various instructions to the users which the Utility Company or the like usually provides. As seen in FIGS. 2*a* and 2*b* the front surface 1*a*, of the portion B includes a framing 8 into which is written the addressee's address and on the same portion B will also be printed the name and address of the sender. Within the front surface 1*a* of the portion C other information may be printed to be sent to all the Service users, said information or communications being normally printed on separate sheets, which in the conventional covers have to be inserted, in turn, separately into the envelope together with the invoice.

Figure 3:
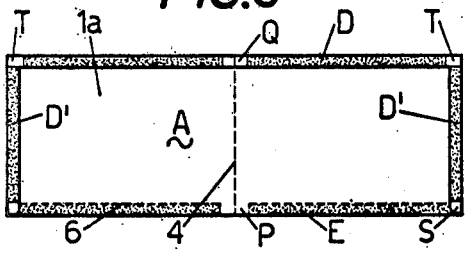
FIG. 3 is a bottom plan view of the inside of the strip element shown in FIGS. 2*a* and 2*b* after it has been folded in accordance with the invention.
Figure 4:
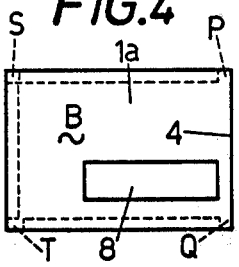
FIG. 4 is a top plan view of the completely folded cover with invoice included formed by the strip element shown in FIG. 3.

The continuous strip of this invention will be used as follows:

The strip 1 is introduced into the machine provided to supply in sequence all data relative to a series of the Service users and this machine is suited to reproduce correctly said data onto the predetermined areas of each strip element without any possibility of misalignments. The strip 1 is then coveyed into a cutter of a conventional type which cuts away the longitudinal sides or longitudinal side portions of the strip 1 up to about the outer longitudinal edges of the slots 7. Successively the strip 1 is mechanically torn along the transverse lines 3 which have been made so as to be more easily torn than the tearing lines 6 so as to obtain strip lengths of the shape shown in FIGS. 2*a* and 2*b*. Said strip lengths or elements are mechanically bent along their transverse lines 5, causing each strip element to be folded so that the two portions of its back surface 1*b* overlap one another so that an "open" cover is thus obtained which, as viewed from its inside, is as shown in FIG. 3, where the main face 1*a* of the invoice A is seen, said invoice A at its lower part being now still joined with the band E. Around the invoice A the bands D', D and D' extend the faces 1*b* of which are now in view as well as the face 1*a* of the band E which carry the adhesive means with the exception of the areas P,Q,S and T. Now it will be sufficient to bend the cover along the centre line 4. The bending machine is also able to apply a pressure to cause the half bands E, the half bands D and the two side bands D' to be bound to each other, thus obtaining a closed cover (FIG. 4) which can be easily opened by pulling the adherent peripheral closure limbs at s, apart by engaging the portions S which are without adhesive and which act as gripping limbs. The so obtained article can be used as a closed cover, which could however, be easily opened so as to take advantage of a reduced postal tax.

Thus, when the user receives the cover, he can easily open the cover and separate the invoice A along the tearing line 6 from the remaining portions of the cover. Afterwards the invoice A becomes a conventional invoice, which could be paid in A/C by any Post Office, keeping a predetermined portion as receipt. Of course, when the cover is closed, the user's address is reproduced in the position required by the U.P.U. Rules so it can be easily read by any electronical optical reader so that there is no risk that the cover can be rejected by the automation apparatus of the Postal Service. In addition there is no risk that the covers can get stuck to other covers, with which they may come into contact, as often occurs using the conventional envelopes or covers, the peripheral edge portions of which may be raised or separated from one another so that a cover can get partially stuck with another.

It is to be pointed out that the inner edge of each left slot 7 obtained by a punching machine serves also to provide a right support means for an optical reader, for performing a checking operation by the Service Body. This is done after the payment at the post Office, using the form associated with the invoice, has been made by the user and a portion of the form has been returned to said Service Body.

In summary, thus the invention comprises a continuous strip or web of paper or the like generally designated 1 which is divided into a plurality of invoice-cover combinations which are individually mailable and include machine-readable address indicia, the web 1 including a longitudinal side portion defined on either longitudinal side of the continuous web which each includes a plurality of longitudinally-spaced perforations 2. A plurality of equally-spaced transverse tear lines 3 are defined across the continuous web by weakness lines which can be folded and later torn to separate the web. Strip elements are defined between each adjacent pair of transverse tear lines 3 and each strip element includes a pair of longitudinal slots 7 extending longitudinally across a portion of each strip element and adjoining each longitudinal side portion of the web as a whole. Each longitudinal slot has a transverse width substantially equal to lower case d. Each strip element comprises an invoice portion A defined between each pair of the longitudinal slots 7, and a cover portion C, B. The invoice portion A and the cover portion C, B, are separated by the transverse fold line 5. Each invoice portion A has a longitudinal height equal to h plus d, where d is the longitudinal width of a first band E which is adjacent the fold line 5. The height h is the longitudinal height of the invoice portion A on which a data is applied. It should be understood that the term "invoice" is being used generically to refer to any bill, debit or the like which may be incorporated in the inventive structure.

Each cover portion C, D, has a longitudinal height equal to h plus 2d with a second band D having a longitudinal width d defined on the cover portion adjacent one of the transverse tear lines 3. The transverse width of each invoice portion A is equal to L which is the distance between the pair of adjacent longitudinal slots 7. The transverse width of each cover portion with the longitudinal side portion cut away is equal to L plus 2*d* and includes two-third bands D' of width d defined on either transverse side thereof. The continuous web 1 has a top face 1*a* and a bottom face 1*b* and includes a central longitudinal fold line 4 defined therein. The longitudinal fold line 4 as with the transverse fold line 5 may be imaginary or printed. The top and bottom face of the continuous web defines the top and bottom faces of each invoice and cover portion with the data and machine readable address indicia being applied to the top faces of the invoice and cover portions respectively. A self-adhering adhesive is applied to at least the major portion of the first band E on the top side 1*a* thereof and to at least the major portion of the second and third bands on the bottom face thereof. Each of the first, second and third bands have one part on one side of the transverse fold line 4 and another part on the other side of the transverse fold line 4. It should be noted that the strip elements are arranged with alternating invoice and cover portions so that the data and address can be applied to the web in a single orientation as the web is fed through the printing machine.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

What we claim is:

1. A continuous strip of paper or the like, which is divisible into a plurality of invoice-cover combinations which are individually mailable and include machine-readable address indicia, comprising:

(a) a continuous web of paper or the like;

(b) a longitudinal side portion defined on each longitudinal side of said continuous web, each including a plurality of longitudinally-spaced perforations;

(c) a plurality of equally spaced transverse tear lines extending across said continuous web;

(d) a strip element defined between each adjacent pair of transverse tear lines in said continuous web;

(e) each strip element including a pair of longitudinal slots extending longitudinally of said continuous web across a portion of said strip element and adjoining each longitudinal side portion of said web respectively;

(f) each strip element comprising an invoice portion defined between each said pair of longitudinal slots;

(g) a cover portion;

(h) each invoice and cover portion of said strip element separated from each other by a transverse fold line;

(i) each invoice portion having a longitudinal height equal to h plus d, where d is the longitudinal width of a first band adjacent said fold line and h is the longitudinal width of said invoice portion on which data is applied;

(j) each cover portion having a longitudinal height equal to h plus 2*d*, with a second band of longitudinal width d defined on said cover portion adjacent one of said transverse tear lines;

(k) the transverse width of each invoice portion equaling L between said pair of longitudinal slots and the transverse width of each cover portion with said longitudinal side portions cut away equalling L plus 2*d* and including a third band of width d defined on each longitudinal side thereof;

(l) said continuous web having a top face and a bottom face and including a central longitudinal fold line defined therein;

(m) the top and bottom faces of said continuous web defining the top and bottom faces of said invoice and cover portions, said data and the machine-readable address indicia being applied to said top face of said invoice and cover portions respectively;

(n) a self-adherent adhesive applied to at least the major portion of said first band on said top face and to at least the major portion of said second and third bands on said bottom face, each one of said bands including a part with adhesive on one transverse side of said central longitudinal fold line and another part with adhesive on the other transverse side of said central fold line;

(o) said strip element being arranged in said web with alternating invoice and cover portions;

(p) whereby said continuous web is machine fed by a machine with dragging and guide means by engagement of the dragging means with said perforations in said longitudinal side portions and stacked by folding said web along said transverse tear lines, said web being divisible into separate strip elements along said transverse tear lines with each strip element being foldable along said transverse fold line and then along said central longitudinal fold line to cover said invoice portion with said cover portion with said top surface of said cover portion being exposed and to bring the adhesive of said one and other parts of each band into contact with each other to seal said cover closed, said cover being openable by disengaging the adhesive of said one part of each band from the adhesive of said other part of each band.

2. A continuous strip according to claim 1, wherein said adhesive is applied to said bands so as to leave a peripheral margin free of adhesive on each of said bands of about 2 mm, whereby said adhesive is sufficiently spaced from portions of said invoice and cover portion on which data and address indicia are applied to prevent smearing of said data and address indicia by said adhesive.

3. A continuous strip according to claim 1, wherein a surface with said adhesive adheres only to another surface with said adhesive and not to the remaining surfaces free of said adhesive and said adhesion between surfaces with said adhesive is of a non-permanent adhesive type.

4. A continuous strip according to claim 1, wherein no adhesive is applied to said third bands in the area thereof adjacent said longitudinal slots for a length slightly greater than the distance d, and no adhesive is applied on said first and second bands in the area adjacent said longitudinal fold line for a length of about 1.5 cm, nor is adhesive applied on said first and second bands within a length of about d of their ends.

5. A continuous strip according to claim 1, further including a second plurality of transverse tear lines extending across said web disposed in said invoice portion and spaced from said transverse fold line by a distance d defining said first band, said second plurality of transverse tear lines having a greater resistance to tearing than said first-mentioned plurality of transverse fold lines.

6. A continuous strip according to claim 1, wherein said central longitudinal fold line is defined by a longitudinal tear line in said invoice section, said longitudinal tear line extending about 2 mm into said cover portion of said strip element.

* * * * *